US005347911A

United States Patent [19]

Hallqvist

[11] Patent Number: 5,347,911

[45] Date of Patent: Sep. 20, 1994

[54] DOUBLE-ACTION RAMMER

[75] Inventor: Sten Hallqvist, Karlskoga, Sweden

[73] Assignee: Bofors AB, Karlskoga, Sweden

[21] Appl. No.: 57,546

[22] Filed: May 6, 1993

[30] Foreign Application Priority Data

May 6, 1992 [SE] Sweden ..... 9201433-1

[51] Int. Cl.[5] ..... F41A 9/14

[52] U.S. Cl. ..... 89/45; 89/47

[58] Field of Search ..... 89/33.05, 36.13, 45, 89/47

[56] References Cited

U.S. PATENT DOCUMENTS

| | | | |
|---|---|---|---|
| 1,360,523 | 11/1920 | Hadcock et al. | 89/47 |
| 3,986,432 | 10/1976 | Schreckenberg | 89/45 |
| 4,183,281 | 1/1980 | Hultgren et al. | 89/47 |
| 4,457,209 | 7/1984 | Scheurich et al. | 89/45 |

FOREIGN PATENT DOCUMENTS

| | | | |
|---|---|---|---|
| 0051119 | 5/1982 | European Pat. Off. . | |
| 368631 | 2/1939 | Italy | 89/45 |
| 409215 | 4/1934 | United Kingdom . | |
| 1490112 | 10/1977 | United Kingdom | 89/47 |

*Primary Examiner*—Stephen C. Bentley

*Attorney, Agent, or Firm*—Pollock, Vande Sande & Priddy

[57] ABSTRACT

In an apparatus and method for separate rapid ramming of shells and propellant charges in a heavy artillery gun in which shells and propellant charges, up to the loading operation are separately stored and separately fed to each respective ramming position in the barrel of the gun, the gun includes two magazines disposed one on each side of the barrel of the gun and the loading apparatus for transferring shells and propellant charges to the breech of the barrel. The loading apparatus includes at least one loading cradle with a first track for shells and a second track for propellant charges, each track having a free-flight rammer. The loading cradle is inwardly pivotally mounted between a replenishment position on a side of the gun barrel and in immediate association with a magazine from which the shells and the propellant charges are loaded into the respective tracks and a ramming position in which the first and second tracks are alternately aligned with the main axis of the gun barrel for separately and successively throwing by the free-flight rammer the shells and propellant charges along their respective tracks into their ramming position in the gun barrel. The magazines and the loading cradle are connected with an elevating system of the gun to follow its movements and are therefore be always parallel with the main axis of the gun barrel.

5 Claims, 4 Drawing Sheets

DOUBLE-ACTION RAMMER

TECHNICAL FIELD

The present invention relates to a method and an apparatus for double-action ramming of separate loading ammunition in large-caliber artillery weapons with the aid of free-flight rammers.

BACKGROUND OF THE INVENTION

In recent years, the wish to increase the rate of fire also for heavy artillery pieces has grown ever stronger. Consequently, several different designs have been proposed in the art. Many of these are based on the employment of fixed magazines which may be of the revolver type or of other design and from which projectiles and propellant charges, either separately, as a unit, or jointly but without physical connection, are transferred to and rammed home in the gun. With fixed magazines and guns which can be moved both in elevation and in traverse and which thus move in relation to the magazine, at least two angular planes and often also one vertical plane must, as a rule, be overbridged before the shell and its propellant charge can be rammed home. In fully automatic loading, this problem is generally solved with the aid of a plurality of ammunition handling cradles which are each pivotal in their plane. By transferring shells and propellant charges between these cradles, all angular and level differences between the breech of the gun and the angular position of the gun barrel and the magazine can be negotiated. However, such designs are of a highly complex nature and it is doubtful whether their complexity is worth the advantages which are attained in that the relatively heavy magazines can be rendered stationary. In addition, the transfer operations of shell and propellant charge between several raisable and pivotal handling cradles is substantially time consuming so, with the result that it is very difficult, employing these designs, to achieve the extremely short ramming times which are current objectives within the art. One main reason for this is that, in combatting a specific target, the ideal situation is to have several shells launched on their way towards the target already before the first shell strikes home.

Patent specification EP AO 051 119 discloses a loading system for large-caliber artillery pieces in which the shell and propellant charge magazines which are here of revolver type are carriage-fixed but not elevatable with the gun, that is they follow the barrel on its angular alignment but not its elevation. In this design, use is made of separate, moving charge cradles or bridges for transferring shells and propellant charges from each respective revolver magazine to the loading position of the gun immediately outside its breech opening and are there aligned in the main axis of the gun barrel. In turn, the loading cradles are each journalled in its pivotal aim disposed beside the gun barrel, this arm being in turn pivotally journalled about that shaft about which the gun barrel is elevated. Thus, the pivotal arms are each movable in a plane lying parallel with the gun barrel. The axes of rotation of the loading cradle are in their turn disposed in the longitudinal direction of the pivot arms. Thus, in this design a two-step or double-action displacement is required of each respective loading cradle from having received a projectile or propellant charge. First, each respective pivot arm must be swung into a position which corresponds to the breech opening of the gun barrel and each respective shell or propellant charge is rammed home.

SUMMARY OF THE INVENTION

According to the present invention, the necessary ramming operation can now be even further speeded up if those magazines from which projectiles and propellant charges are connected are mounted on or follow the elevating system and, preferably, are mounted about the point of gravity of the gun barrel or on a cradle which, while being separate, is elevated and bearing-aligned in parallel with the gun barrel. In such instance, only an inward pivoting movement for the loading cradle will then be required.

According to the present invention, these magazines are supplemented with loading cradles or loading bridges intended for shell and propellant charge respectively, the cradles or bridges being pivotal from a replenishment position beside the gun barrel and in immediate association with the relevant magazine, into a ramming position axially centered with the main axis of the gun barrel. Each respective loading cradle further includes a free-flight rammer which is activated when the loading cradle reaches the ramming position and which then accelerates the shell or propellant charge in the longitudinal direction of the cradle so that the object located therein is thrown at high velocity into its ramming position.

The loading cradles may be two in number which, in sequence after one another and from either side of the gun, are swung into the ramming position. Alternatively, the two cradles can be integrated into a single unit with two accommodation tracks or charge cups, one for shell and one for propellant, and a free-flight rammer for each track.

Given that the shell and its propellant charge are of completely different weights, the free-flight rammer for the propellant charge may be of considerably less power than that employed for the shell proper.

BRIEF DESCRIPTION OF THE ACCOMPANYING DRAWINGS

The present invention has been defined in the appended Claims and will now be described in greater detail hereinbelow, with particular reference to the accompanying Drawings. In the accompanying Drawings:

DESCRIPTION OF PREFERRED EMBODIMENT

Figure 1:
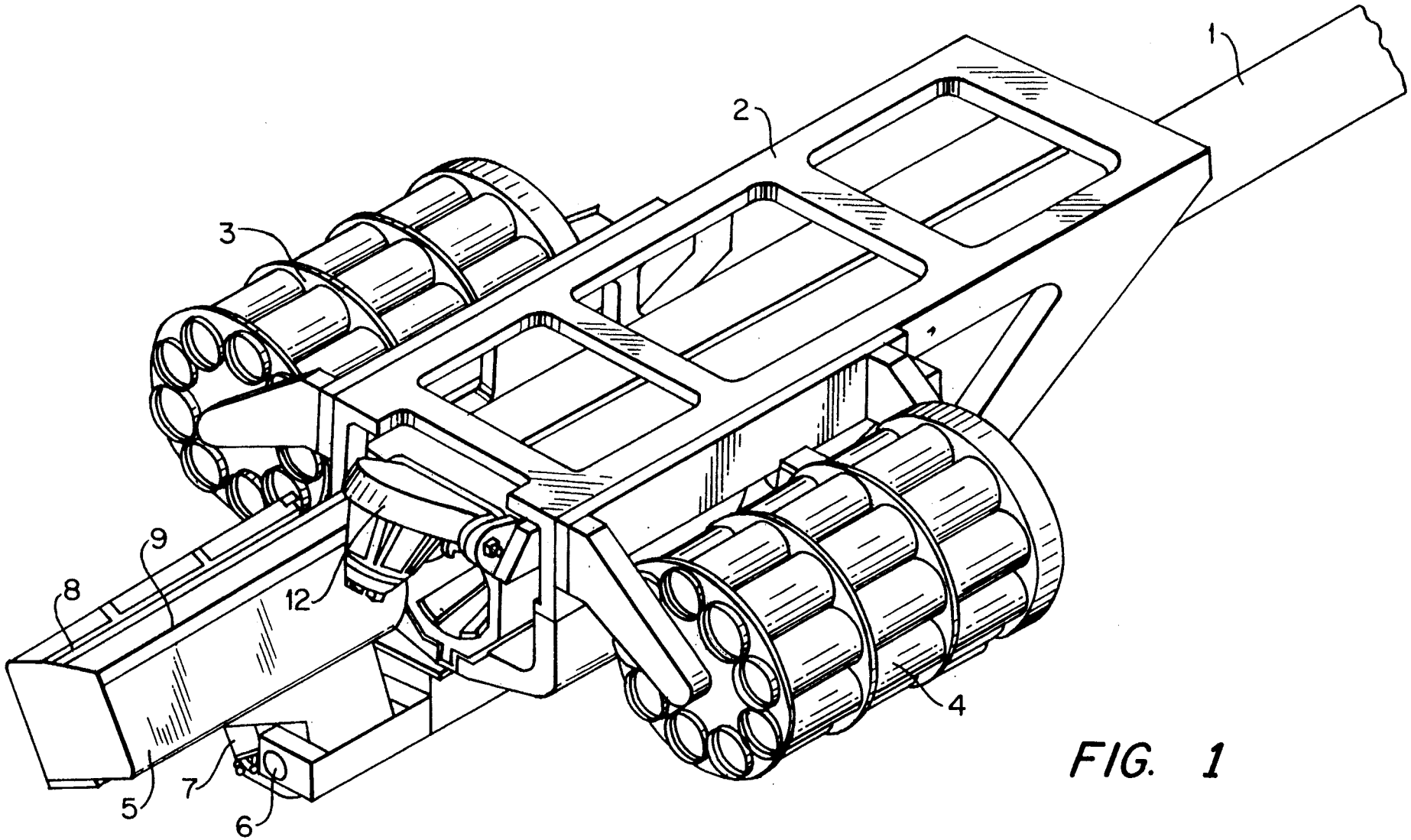
FIG. 1 is an oblique projection of the elevation system in an artillery gun.
Figure 2:
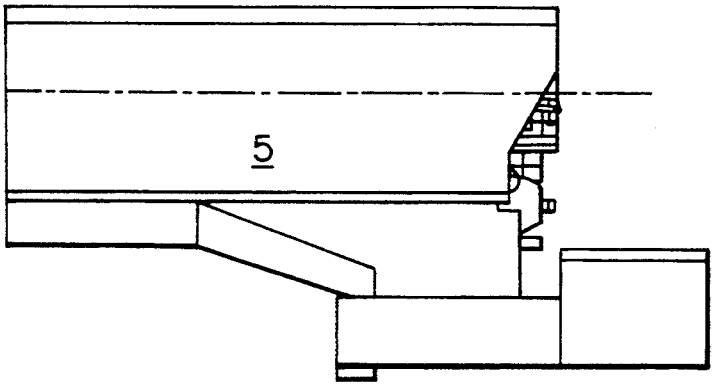
FIG. 2 is a side elevation of the loading cradle thereof.

All parts carry the same reference numerals throughout all Drawings. However, for the sake of greater clarity not all parts are shown in all Figures.

FIG. 1 thus shows the elevation system of an artillery piece with a barrel 1, a carriage 2 which carries two rotary revolver magazines 3 and 4 for shells and propellant charges. A loading cradle 5 is further pendulum suspended at the carriage 2. The shaft of the loading cradle 5 is designated 6 and its pendulum position is determined by a hydraulic ram 7.

Figure 5:
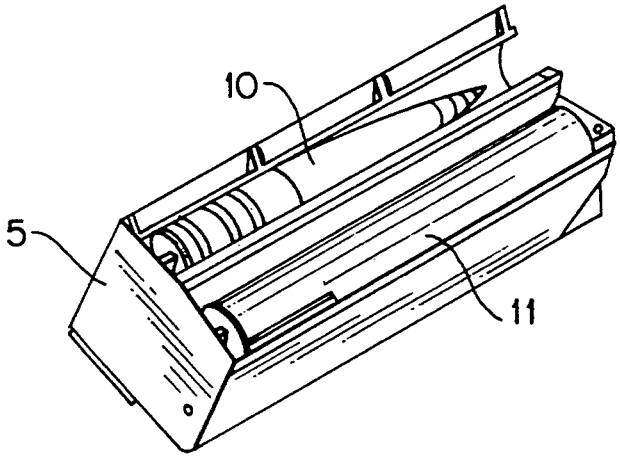
FIG. 5 shows the loading cradle in the ramming position for the shell.
Figure 7:
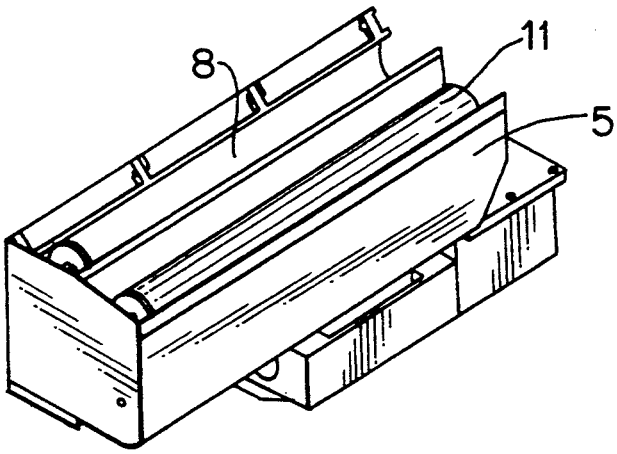
FIG. 7 shows the loading cradle in the ramming position for the propellant charge.
Figure 8:
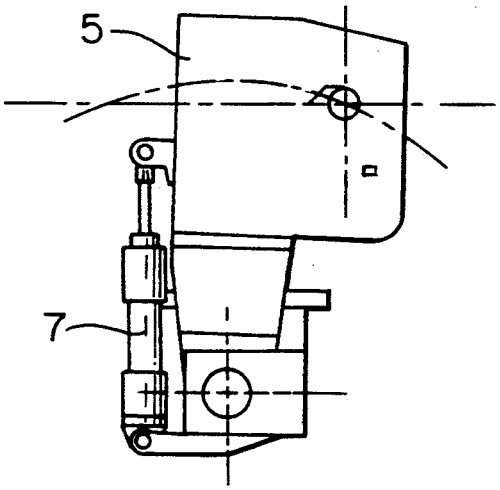
FIG. 8 shows the loading cradle of FIG. 7, seen from behind.

The loading cradle has two tracks 8 and 9, one intended for a shell 10 (see FIG. 5) and one for a propellant charge 11 (see FIGS. 5 and 7).

A free-flight rammer (not shown) is disposed in each respective track in the loading cradle. These rammers are designed employing known technology, fox which reason they will not be discussed in greater detail in the present context. One of the free-flight rammers is intimated in FIG. 9.

The screw mechanism 12 of the gun is also visible in FIG. 1.

The entire loading and ramming sequence relevant in connection with the present invention may be followed from FIGS. 1 and 3–8.

Figure 3:
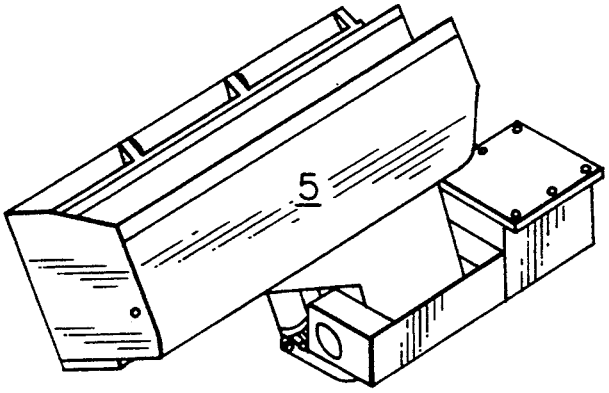
FIG. 3 is an oblique projection of the loading cradle in the replenishment position, that is in the same position as FIG. 1.
Figure 4:
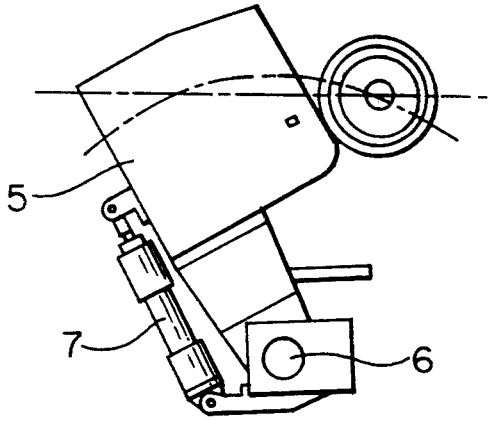
FIG. 4 shows the loading cradle of FIG. 3, seen from behind.

In FIGS. 1 and 3, the loading cradle 5 is in the same position, that is the loading or replenishment position where its tracks 8 and 9 are supplied with a shell 10 and propellant charge 11, respectively, from two mutually subsequent chambers in the revolver magazine 3 whose chambers thus alternatingly contain shells and propellant charges. The same relationship also applies to the magazine 4. One alternative is also to house propellant charges in one magazine and shells in another, but this gives rise to shear loadings because of the different weights of the contents of each magazine.

Figure 6:
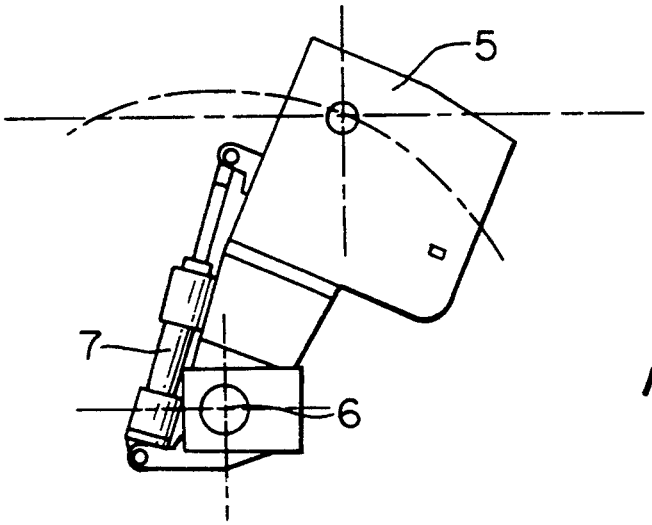
FIG. 6 is a view of the loading cradle of FIG. 5, seen from behind.

When both tracks 8 and 9 of the loading carriage 5 have been filled with a shell 10 and a propellant charge 11, respectively, the loading cradle is moved by the hydraulic ram 7 to the ramming position illustrated in FIGS. 5 and 6 for the shell 10, that is with the track 8 carrying the shell centered with the main axis of the gun barrel 1, and thereafter the free flight rammer of the track 8 is activated and the shell 10 is thrown into its ramming position. As soon as this has taken place and while the free flight rammer is returned to its starting position, the loading cradle is moved to the position illustrated in FIGS. 7 and 8 where the propellant charge is free-flight rammed in a corresponding manner, whereafter the screw mechanism or breech block of the gun is closed while the loading cradle is moved to either magazine 3 or magazine 4 for reloading which must be completed when the gun barrel 1 has recuperated to its starting position after the recoil from the preceding round.

As will have been apparent from the foregoing, this ramming system affords the possibility of extremely high firing sates even in large calibre artillery pieces.

Figure 9:
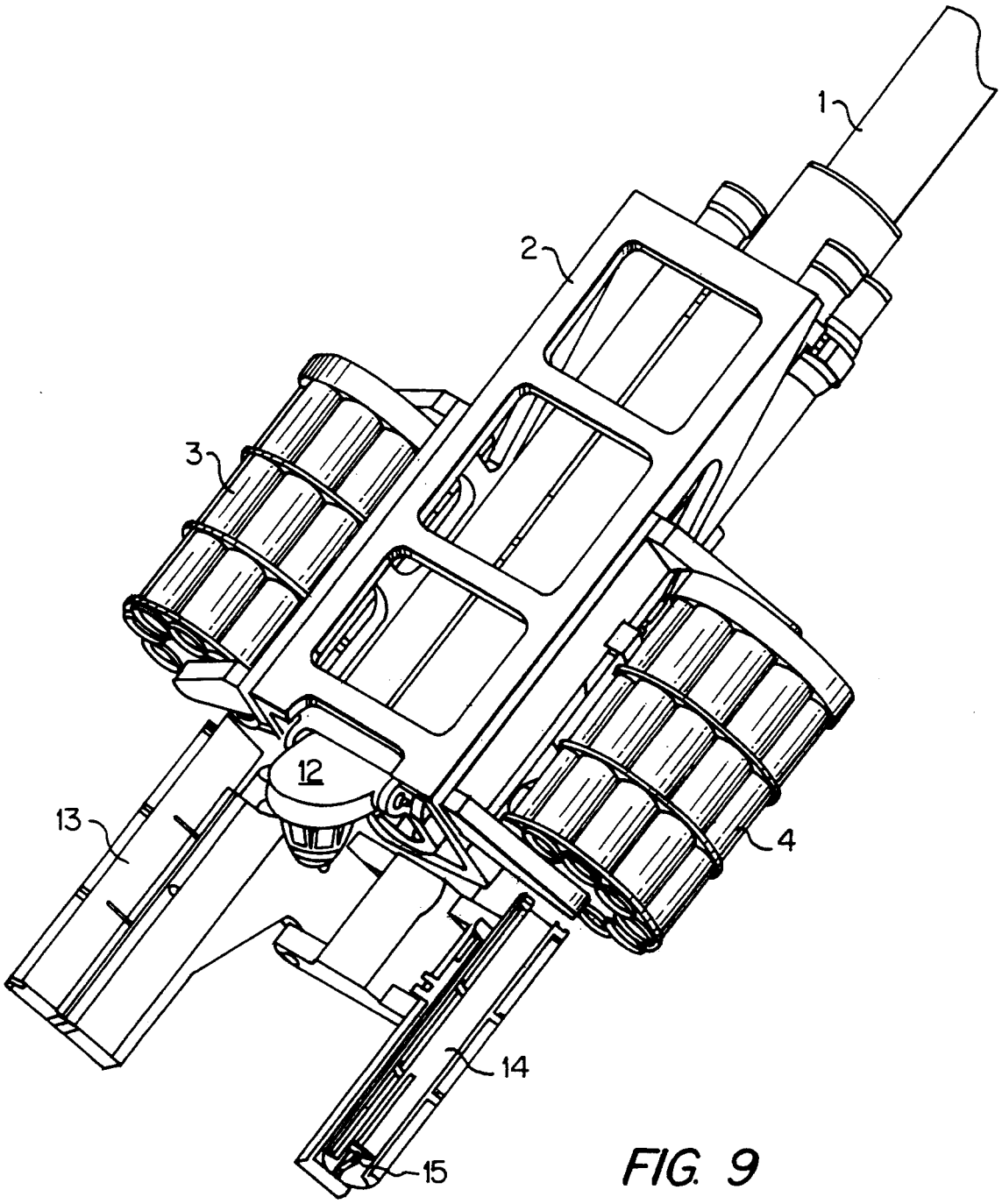
FIG. 9 shows a variation of the apparatus according to FIG. 1, but here with two loading cradles, one for the shell and one for the propellant charge.

In the variant illustrated in FIG. 9, the loading cradle is divided into two parts, consisting of a left-hand mounted loading cradle 13 for the shell 10 and a right-hand mounted loading cradle 14 for propellant charges 11. The free-flight rammer 15 for the latter is intimated in the figure.

Apart from the loading cradles 13 and 14 being sequentially moved into line with the breech opening of the gun barrel 1 and thereafter straight back to their respective loading or replenishment positions at each respective magazine 3 and 4, this alternative operates in exactly the same manner as the apparatus described with particular reference to FIG. 1.

A further conceivable variation is a combination between the apparatuses illustrated in FIGS. 1 and 9, that is consisting of double loading cradles or loading bridges, each provided with two loading trays or tracks, one for a shell and one for a propellant charge whose location relative to each other may be identical or mirror-reversed depending upon programming of the control system. In such an arrangement, the loading speed can be even further increased.

The present invention should not be considered as restricted to that described above and shown in the Drawings, many modifications being conceivable without departing from the spirit and scope of the appended Claims.

What we claim and desire to secure by Letters Patent is:

1. A loading apparatus for separate ramming of shells and propellant charges in a gun including two magazines disposed one on each side of the barrel of the gun, and the loading apparatus for transferring shells and propellant charges to the breech of the barrel, the loading apparatus comprising:

at least one loading cradle including a first track for shells and a second track for propellant charges;

said first and second track each being provided with a free-flight rammer;

said loading cradle being inwardly pivotally mounted between a first replenishment position on a side of the gun barrel and in immediate association with a magazine from which shells are to be loaded into said first track and propellant charges into said second track, and a second ramming position of said loading cradle in which said first and second track are alternately aligned with the main axis of the gun barrel for separately and successively throwing by said free-flight rammers said shells and propellant charges along their respective tracks into their ramming position in the gun barrel; and wherein said two magazines and said at least one loading cradle are connected with an elevating system of the gun to follow the movements of the elevating system and are therefore always positioned parallel with the main axis of the gun barrel.

2. A loading apparatus according to claim 1 wherein said first and second tracks of said loading cradle are disposed parallel to each other.

3. A loading apparatus according to claim 1 including two loading cradles, one for shells and one for propellant charges which, from their respective replenishment positions on either side of the gun are inwardly pivotal in mutual sequence after one another with interspersed free-flight ramming of shells, to a common ramming position in alignment with the breech opening of the gun.

4. A loading apparatus according to claim 1 including two loading cradles or loading bridges each comprising two tracks or loading trays, one for shells and one for propellant charges, said loading cradles or loading bridges being alternatingly moved into immediate proximity of the breech opening of the gun, and alternatingly to a replenishment position into the vicinity of each respective magazine.

5. A method for separate rapid ramming of shells and propellant charges in a gun including two magazines disposed one on each side of the barrel of the gun and a loading apparatus with at least one loading cradle including a first and a second track for shells and propellant charges, said method including the steps of:

loading the shells from at least one of the magazines into one of the tracks and the propellant charges into the other track in a first replenishment position of the loading cradle on a side of the gun barrel and in immediate association with the magazine;

inwardly pivotally moving said replenished loading cradle from said first position into a second ramming position of said loading cradle in which said first and second tracks are alternately aligned with the main axis of the gun barrel;

separately and successively throwing by a free -flight rammer positioned in respective tracks said shells and propellant charges into their ramming position in the gun barrel along their respective tracks; and connecting said magazines and said loading cradle with an elevating system of the gun to follow the movements of the elevating system and therefore to be always parallel with the main axis of the gun barrel.

* * * * *